US005396024A

United States Patent [19]

Noguchi et al.

[11] Patent Number: 5,396,024

[45] Date of Patent: Mar. 7, 1995

[54] ELECTRIC PERCUSSION INSTRUMENT EQUIPPED WITH VIBRATION SENSOR SUPPORTED BY RETAINER OF VIBRATION-TRANSMISSIVE SUBSTANCE

[75] Inventors: Yoshitaka Noguchi; Minoru Harada; Syuzo Kurokawa, all of Shizuoka, Japan

[73] Assignee: Yamaha Corporation, Hamamatsu, Japan

[21] Appl. No.: 160,041

[22] Filed: Nov. 30, 1993

[30] Foreign Application Priority Data

Dec. 1, 1992 [JP] Japan ..... 4-322136
Apr. 9, 1993 [JP] Japan ..... 5-083661

[51] Int. Cl.[6] ..... G10H 3/14
[52] U.S. Cl. ..... 84/730
[58] Field of Search ..... 84/730, 743, 452 P, 84/452 R

[56] References Cited

U.S. PATENT DOCUMENTS 4,669,349 6/1987 Hyakutaka ..... 84/DIG. 12 X
4,679,479 7/1987 Koyamato .
4,841,830 6/1989 Yamashita .
4,947,725 8/1990 Nomura ..... 84/723
5,105,710 4/1992 Rothmel ..... 84/730
5,293,000 3/1994 Adinolfi ..... 84/730

FOREIGN PATENT DOCUMENTS 2544115 4/1983 France .
2602607 8/1986 France .
59-39753 11/1984 Japan .
2192087 6/1987 United Kingdom .
8604718 2/1986 WIPO .

*Primary Examiner*—Jonathan Wysocki
*Assistant Examiner*—Jeffrey W. Donels
*Attorney, Agent, or Firm*—Spensley Horn Jubas & Lubitz

[57] ABSTRACT

A pad member of an electric percussion instrument is supported through a cushion member by a case member for isolating the pad member from noise produced in the case member upon strikes of the pad member, and a vibration sensor is connected with the pad member by means of a sensor board of vibration transmissive substance so as to propagate the vibrations of the pad member to the vibration sensor without any influence of the noise.

14 Claims, 3 Drawing Sheets

ELECTRIC PERCUSSION INSTRUMENT EQUIPPED WITH VIBRATION SENSOR SUPPORTED BY RETAINER OF VIBRATION-TRANSMISSIVE SUBSTANCE

FIELD OF THE INVENTION

This invention relates to an electric percussion instrument and, more particularly, to an electric percussion instrument equipped with a vibration sensor supported by a retainer of vibration-transmissive substance.

DESCRIPTION OF THE RELATED ART

A typical example of the electric percussion instrument is disclosed in Japanese Utility Model Publication of Unexamined Application No. 59-39753, and comprises a tubular member with an inner space, heads covering both ends of the tubular member and a cushion member of porous substance such as sponge filling the inner space and a vibration sensor of a piezo-electric element embedded in the cushion member. The vibration sensor is adjusted to a center of the inner space, and the cushion member is expected to isolate the vibration sensor from forced vibrations of the tubular member.

In a performance, while a player is beating the head, not only the head but also the tubular member vibrate at respective characteristic frequencies, and the cushion member takes up the forced vibrations of the tubular. As a result, the vibration sensor is expected to detect the vibrations of the head. The vibration sensor produces an electric signal indicative of the vibrations of the head, and a speaker system reproduces the sound from the electric signal.

However, the cushion member takes up not only the vibrations of the tubular member but also the vibrations of the head, and the vibrations at a soft beat are too weak to be detected by the vibration sensors. This means that soft beats are liable to be lost in the reproduction of the sounds.

SUMMARY OF THE INVENTION

It is therefore an important object of the present invention to provide an electric percussion instrument which faithfully detects vibrations without any influence of forced vibrations of a case member.

To accomplish the object, the present invention proposes to support a vibration sensor by means of a retainer of vibration transmissive substance connected with a pad member.

In accordance with the present invention, there is provided an electric percussion instrument comprising: a case member vibratory when a force is exerted; a pad member producing vibrations when a player beats; a vibration sensor operative to detect the vibrations for producing an electric signal indicative of the vibrations; a retainer supporting the vibration sensor, and formed of vibration transmissive substance for propagating the vibrations to the vibration sensor; and a cushion means provided between the case member and the pad member, and isolating the retainer from a noise produced in the case member.

BRIEF DESCRIPTION OF THE DRAWINGS

The features and advantages of the electric percussion instrument according to the present invention will be more clearly understood from the following description taken in conjunction with the accompanying drawings in which.

DESCRIPTION OF THE PREFERRED EMBODIMENTS

First Embodiment

Figure 1:
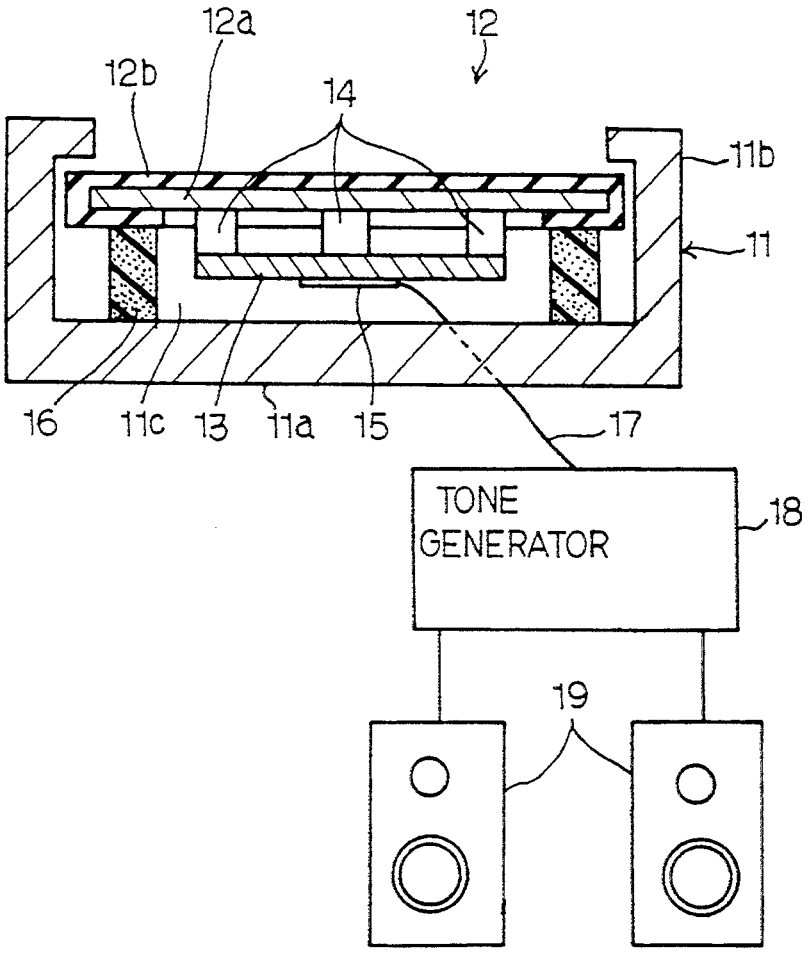
FIG. 1 is a cross sectional view showing the structure of an electric percussion instrument according to the present invention.

Referring first to FIG. 1 of the drawings, an electric percussion system embodying the present invention is comprises a case member 11, a pad member 12, a sensor board 13, a plurality of stud members 14, a piezo-electric element 15 and a cushion member 16. In this instance, the sensor board 13 and the plurality of stud members 14 as a whole constitute a retainer, and the piezo-electric element 15 serves as a vibration sensor.

The case member 11 has a bottom portion 11*a* and a wall portion 11*b* merged with the bottom portion 11*a*, and, accordingly, the case member 11 forms a hollow space 11*c* therein.

The pad member 12 is implemented by a pad plate 12*a* formed of iron and partially covered with rubber. The rubber film 12*b* protects an upper surface of the pad plate 12*a* against impacts at beats by a player, and exposes a central area of the back surface of the pad plate 12*a*.

The sensor board 13 is formed of a vibration-transmissive substance selected from the group consisting of iron and acrylonitrile-butadiene-styrene resin, and is fixed to the exposed central area of the back surface of the pad plate 12 by means of the plurality of stud members 14. The plurality of stud members 14 are also formed of the vibration-transmissive substance, i.e., either iron or acrylonitrile-butadiene-styrene resin, and the plurality of stud members 14 and the sensor board 12*a* well propagate vibrations produced in the pad plate 12*a* to the piezoelectric element 15.

Figure 2:
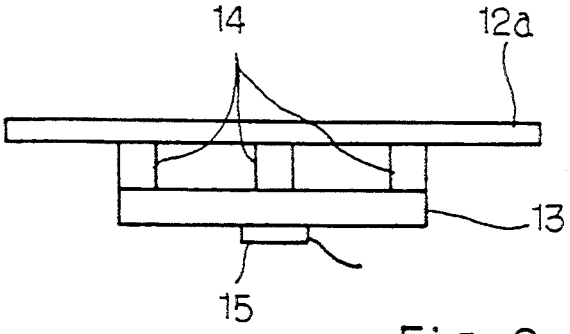
FIG. 2 is a front view showing a pad and a sensor board incorporated in the electric percussion instrument.

The plurality of stud members 14 are connected between the exposed area of the pad plate 12*a* and a peripheral area of the sensor board 13 as shown in FIG. 2, and may be fixed to predetermined locations on the sensor board 13 where the nodes of composite vibrations take place. Each of the plurality of stud members 14 is angularly spaced apart from the adjacent stud members by a predetermined angle, and the predetermined angle is 90 degrees in this instance.

Figure 3:
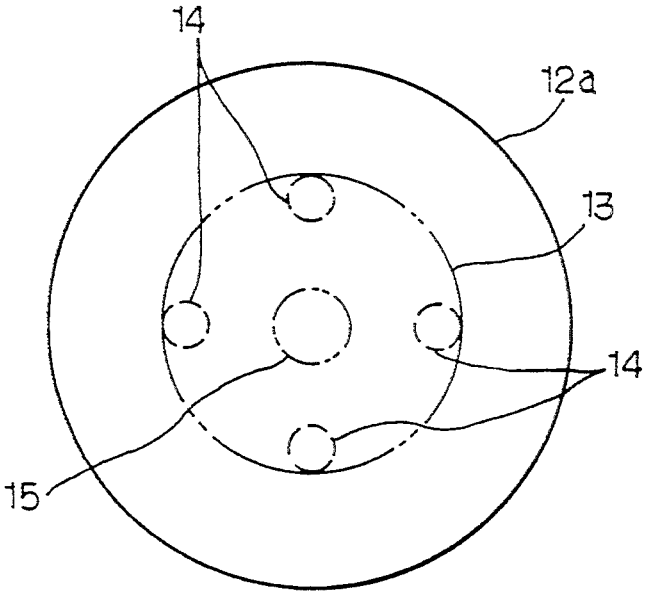
FIG. 3 is a plan view showing the pad and the sensor board.

The piezo-electric element 15 is fixed to a central area of the sensor board 13 as shown in FIG. 3, and is equally spaced from the plurality of stud members 14 in the peripheral area of the sensor board 13. The central area of the sensor board 13 is less affected by the interference between the vibrations propagated through the plurality of stud members 14, and the piezo-electric element 15 can produces an electric signal exactly indicative of the vibrations produced in the pad plate 12*a*. Further, the electric signal do not vary its level substantially with an identical beating at a different beaten point over the pad member. Because, the difference in the effective length of the propagation path is rather small.

Turning back to FIG. 1 of the drawings, the piezo-electric element 15 is connected through wires 17 with a tone generator system 18, and the tone generator system drives a speaker system 19 so as to appropriately produce sounds indicated by the vibrations of the pad plate 12*a*.

The cushion member 16 is shaped in a tubular configuration, and is formed of urethane foam. The cushion member 16 of urethane foam is effective against a noise produced in the case member 11, and isolates the piezo-electric element 15 from the noise.

The pad plate 12*a*, the stud members 14 and the sensor board 13 are fixed in a following manner.

First, if the sensor board 13 is formed of acrylonitrile-butadiene-styrene resin, the stud members 14 of acrylonitrile-butadiene-styrene resin are either bolted or bonded to the pad plate 12*a*, and the sensor board 13 is either bolted or bonded to the stud members 14.

On the other hand, the stud members 14 of iron are welded or bolted to the pad plate 12*a*, and the sensor board 13 of acrylonitrile-butadiene-styrene resin is either bolted or bonded to the stud members 14.

If the sensor board 13 is formed of iron, the stud members 14 of acrylonitrile-butadiene-styrene resin are either bonded or bolted to the pad plate 12*a* as well as to the sensor board 13.

The stud members 14 of iron are either welded or bolted to the pad plate as well as the sensor board 12*a* of iron.

In a performance, the player beats the pad member 12, and vibrations are propagated from the beaten point over the pad member 12. The pad member 12 and the case member 11 are isolated from each other by means of the cushion member 16, and the pad member 12 is free from a noise produced in the case member 11, if any.

The stud members 14 propagate the vibrations of the pad member 12 to the sensor board 13, and accelerates the sensor board 13. Then, vibrations take place in the sensor board, and the piezo-electric element 15 produces the electric signal from the vibrations. The electric signal is transferred to the tone generator system 18 for electronically synthesizing sound signals, and the sound signals are transferred to the speaker system 19 for producing sounds.

Although the vibrations are decayed during the propagation through the stud members 14 and the sensor board 13, the decay is ignoreable rather than the prior art, and the vibrations at a soft beat is large enough to be detectable by the piezo-electric element 15. As a result, any beat is never lost from the sounds produced by the speaker system 19. Moreover, any one of the stud members 14 chatches and transfers the vibrations depending upon the beaten point, and any time delay is never introduced in the propagation.

Moreover, the stud members 14 are arranged in such a manner as to allow the sensor board 13 to freely vibrate, and faithfully reproduce the vibrations of the pad plate 12*a*.

Second Embodiment

Figure 4:
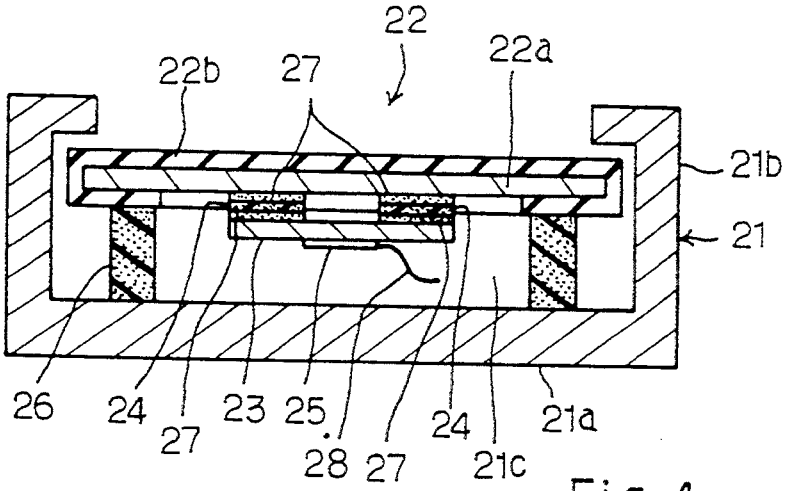
FIG. 4 is a cross sectional view showing another electric percussion instrument according to the present invention.
Figure 5:
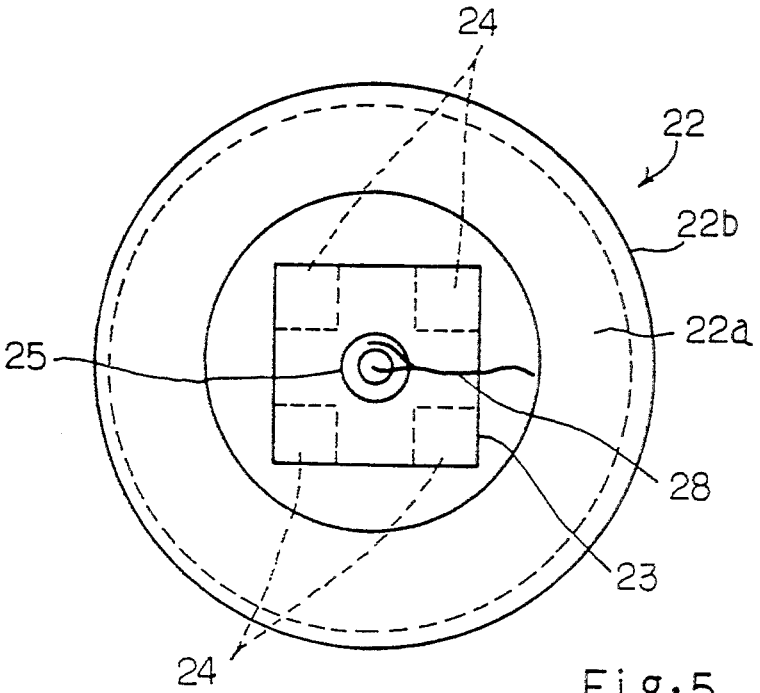
FIG. 5 is a bottom view showing a vibration sensor supported by a sensor board incorporated in the electric percussion instrument shown in FIG. 4.

Turning to FIGS. 4 and 5 of the drawings, another electric percussion instrument embodying the present invention comprises a case member 21, a pad member 22, a sensor board 23, a plurality of damping members 24, a piezo-electric element 25, a cushion member 26 and adhesive sheets 27. In this instance, the sensor board 13 serves as a retainer, and the piezo-electric element 15 serves as a vibration sensor.

The case member 21 has a bottom portion 21*a* and a wall portion 21*b* merged with the bottom portion 21*a*, and, accordingly, the case member 21 forms a hollow space 21*c* therein.

The pad member 22 is implemented by a pad plate 22*a* partially covered with a rubber film 22*b*. The pad plate 22*a* is formed of iron, and is 1.0 millimeter in thickness. The rubber film 22*b* protects an upper surface of the pad plate 22*a* against strong impacts at beats by a player, and exposes a central area of the back surface of the pad plate 22*a*.

The sensor board 33 is formed of a vibration-transmissive substance selected from the group consisting of iron and acrylonitrile-butadiene-styrene resin. When vibrations of the pad plate 22*a* are propagated to the sensor board 23, and the sensor board 23 per se well vibrates, and propagates the vibrations to the piezo-electric element 25 without any substantial damping. When the sensor board 33 is formed of acrylonitrile-butadiene-styrene resin, the sensor board 33 is 2.0 millimeters in thickness, and measures 60 millimeters by 60 millimeters. On the other hand, if the sensor board 33 is formed of iron, the thickness is 0.6 millimeter, and the dimensions are equal to that formed of acrylonitrile-butadiene-styrene resin.

The damping members 24 are bonded between the exposed area of the pad plate 22*a* and four corner areas of the sensor board 23 by means of the adhesive sheets 27. The damping members 24 are formed of porous material such as, for example, cellular polyethylene, and each measures 20 millimeters by 20 millimeters. In this instance, the thickness of the damping members 24 is 1.2 millimeters.

The damping members 24 thus inserted between the pad plate 22*a* and the sensor board 23 appropriately damp the vibrations of the pad plate 22*a*, and causes the vibrations of the sensor board 23 to be fallen into the detectable range of the piezo-electric element 25. For this reason, the damping members 24 are changed to appropriate dimensions depending upon the expected range of impacts, and the thickness of the damping members 24 ranges from 1.0 millimeter to 10 millimeters. If an electric percussion instrument according to the present invention is of a kicked pad, the damping members 24 are changed to be 10 millimeters in thickness, and measure 60 millimeters by 10 millimeters, by way of example.

Moreover, the damping members 24 regulates the propagation of the vibrations. When a player beats the pad member 22 at an arbitrary point, the vibrations are diffused from the impact point toward the damping members 24, and a time lug tends to be introduced between an arrival time at one of the damping members 24 and an arrival time at another damping member 24. In general, the time lugs introduce phase differences between the vibrations propagated to the sensor board 23, and undesirably modify the composite vibrations produced in the sensor board 23. However, the damping members 24 take up the time lugs, and faithfully produce the vibrations in the sensor board 23.

The piezo-electric element 25 is fixed to a central area of the sensor board 23, and is equally spaced from the plurality of damping members 24 at the corner areas of the sensor board 23. The central area of the sensor board 23 is less affected by the interference between the vibrations propagated through the plurality of damping members 24, and the piezo-electric element 25 can produce an electric signal exactly indicative of the vibrations produced in the pad plate 22*a*.

Though not shown in the drawings, the piezo-electric element 25 is connected through wires 28 with a tone generator system as similar to the first embodiment, and the tone generator system drives a speaker system so as to produce sounds indicated by the vibrations of the pad plate 12*a*.

The cushion member 26 is shaped in a tubular configuration, and is formed of urethane foam. The cushion member 26 of urethane foam is effective against a noise produced in the case member 21, and isolates the piezo-electric element 25 from the noise.

The electric percussion instrument according to the present invention achieves not only the goals of the first embodiment but also appropriately regulates the vibrations of the sensor board to the detectable range of the piezo-electric element 25 by means of the damping members 24.

Although particular embodiments of the present invention have been shown and described, it will be obvious to those skilled in the art that various changes and modifications may be made without departing from the spirit and scope of the present invention. For example, the vibration sensor may be implemented by any displacement-to-electric signal converter such as, for example, a semiconductor acceleration sensor with a Wheatstone bridge circuit, and the electric percussion instrument according to the present invention may be connected with an amplifier system.

What is claimed is:

1. An electric percussion instrument comprising:

a case member that vibrates when a force is exerted on the electric percussion instrument;

a pad member producing vibrations when a player exerts the force on the pad member;

a vibration sensor operative to detect said vibrations for producing an electric signal indicative of said vibrations;

a retainer supporting said vibration sensor, and formed of a vibration-transmissive substance for propagating said vibrations to said vibration sensor, said retainer including a plurality of stud members fixed to said pad member and a sensor board fixed to said plurality of stud members and supporting said vibration sensor, said plurality of stud members being formed of the vibration-transmissive substance selected from the group consisting of iron and acrylonitrile-butadiene-styrene resin, and said sensor board being formed of the vibration-transmissive substance selected from the group consisting of iron and acrylonitrile-butadiene-styrene resin; and a cushion provided between said case member and said pad member, and isolating said retainer from noise produced in said case member.

2. The electric percussion instrument as set forth in claim 1, in which said pad member is implemented by a vibratory pad plate partially covered with rubber.

3. The electric percussion instrument as set forth in claim 1, in which said vibration sensor is implemented by a piezo-electric element.

4. The electric percussion instrument as set forth in claim 1, in which said cushion is implemented by a tube-shaped member of urethane foam.

5. An electric percussion instrument comprising:

a case member that vibrates when a force is exerted on the electric percussion instrument;

a pad member producing vibrations when a player exerts the force on the pad member;

a vibration sensor operative to detect said vibrations for producing an electric signal indicative of said vibrations;

a retainer supporting said vibration sensor, and formed of a vibration-transmissive substance for propagating said vibrations to said vibration sensor, said retainer including a plurality of stud members fixed to said pad member and a sensor board fixed to said plurality of stud members and supporting said vibration sensor, said plurality of stud members being angularly spaced apart from each other by a predetermined angle in a peripheral area of said sensor board, and said vibration sensor being fixed to a central area of said sensor board radially spaced apart from said plurality of stud members by a predetermined distance; and a cushion provided between said case member and said pad member, and isolating said retainer from noise produced in said case member.

6. The electric percussion instrument as set forth in claim 5, in which said pad member is implemented by a vibratory pad plate partially covered with rubber.

7. The electric percussion instrument as set forth in claim 5, in which said vibration sensor is implemented by a piezo-electric element.

8. The electric percussion instrument as set forth in claim 5, in which said cushion is implemented by a tube-shaped member of urethane foam.

9. An electric percussion instrument comprising:

a case member that vibrates when a force is exerted on the electric percussion instrument;

a pad member producing vibrations when a player exerts the force on the pad member;

a vibration sensor operative to detect said vibrations for producing an electric signal indicative of said vibrations;

a retainer supporting said vibration sensor, and formed of a vibration-transmissive substance for propagating said vibrations to said vibration sensor;

a damping means connected between said pad member and said retainer for regulating said vibrations of said retainer to a detectable range of said vibration sensor, said damping means having dimensions that are changeable depending upon the magnitude of the force exerted on said pad member, wherein said damping means is implemented by a plurality of damping members of a porous material, and wherein said retainer is implemented by a sensor board of the vibration-transmissive substance selected form the group consisting of iron and acrylonitrile-butadiene-styrene resin; and a cushion provided between said case member and said pad member, and isolating said retainer from noise produced in said case member.

10. The electric percussion instrument as set forth in claim 9, in which said pad member is implemented by a vibratory pad plate partially covered with rubber.

11. The electric percussion instrument as set forth in claim 9, in which said vibration sensor is implemented by a piezo-electric element.

12. The electric percussion instrument as set forth in claim 9, in which said cushion is implemented by a tube-shaped member of urethane foam.

13. An electric percussion instrument comprising:

a case member having a bottom portion and a wall portion projecting from a periphery of said bottom portion, and that vibrates when a force is exerted on the electric percussion instrument;

a pad member having a pad plate partially covered with rubber, and producing vibrations when a player exerts the force on the pad member;

a piezo-electric vibration sensor operative to detect said vibrations for producing an electric signal indicative of said vibrations;

a plurality of stud members formed of a vibration-transmissive substance selected from the group consisting of iron and acrylonitrile-butadiene-styrene resin, and fixed in parallel to an exposed area of said pad plate, said plurality of stud members being angularly spaced apart from one another by a predetermined angle;

a sensor board having a peripheral area fixed to said plurality of stud members and a central area supporting said piezo-electric vibration sensor radially and evenly spaced apart from said plurality of stud members, and formed of the vibration transmissive substance selected from the group consisting of iron and acrylonitrile-butadiene-styrene resin; and a tube-shaped cushion of urethane foam connected between said case member and said pad member, and isolating said piezo-electric vibration sensor from noise produced in said case member.

14. An electric percussion instrument comprising:

a case member having a bottom portion and a wall portion projecting from a periphery of said bottom portion, and that vibrates when a force is exerted on the electric percussion instrument;

a pad member having a pad plate of iron partially covered with rubber, and producing vibrations when a player exerts the force on the pad member;

a piezo-electric vibration sensor operative to detect said vibrations for producing an electric signal indicative of said vibrations;

a plurality of damping members formed of cellular polyethylene, and bonded to an exposed area of said pad plate in a spaced relationship from one another;

a sensor board having a peripheral area fixed to said plurality of damping members and a central area supporting said piezo-electric vibration sensor, and formed of the vibration transmissive substance selected from the group consisting of iron and acrylonitrile-butadiene-styrene resin; and a tube-shaped cushion of urethane foam connected between aid case member and said pad member, and isolating said piezo-electric vibration sensor from noise produced in said case member.

* * * * *